US009969164B2

(12) United States Patent
McKinnell et al.

(10) Patent No.: US 9,969,164 B2
(45) Date of Patent: May 15, 2018

(54) FLUID EJECTION APPARATUSES INCLUDING COMPRESSIBLE MATERIAL

(71) Applicant: Hewlett-Packard Development Company, L.P., Houston, TX (US)

(72) Inventors: James McKinnell, Salem, OR (US); Tony S. Cruz-Uribe, Independence, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/364,202

(22) Filed: Nov. 29, 2016

(65) Prior Publication Data

US 2017/0080712 A1 Mar. 23, 2017

Related U.S. Application Data

(63) Continuation of application No. 13/931,381, filed on Jun. 28, 2013, now Pat. No. 9,539,809.

(51) Int. Cl.

| | |
|---|---|
| ***B41J 2/165*** | (2006.01) |
| ***B41J 2/14*** | (2006.01) |
| ***B41J 2/055*** | (2006.01) |

(52) U.S. Cl.

CPC ..... *B41J 2/1433* (2013.01); *B41J 2/055* (2013.01); *B41J 2/14201* (2013.01); *B41J 2/14233* (2013.01); *B41J 2002/14419* (2013.01)

(58) Field of Classification Search

None

See application file for complete search history.

(56) References Cited

U.S. PATENT DOCUMENTS

| | | | | |
|---|---|---|---|---|
| 6,371,598 | B1 | 4/2002 | Fujii et al. | |
| 8,382,235 | B2 | 2/2013 | Akahane | |
| 2002/0080215 | A1 | 6/2002 | Sakaida et al. | |
| 2010/0039480 | A1* | 2/2010 | Brown | B41J 2/055 347/68 |
| 2010/0214371 | A1* | 8/2010 | Okazawa | B41J 2/14274 347/70 |
| 2011/0187796 | A1* | 8/2011 | Akahane | B41J 2/04 347/54 |
| 2011/0199437 | A1 | 8/2011 | Miyata | |
| 2011/0211026 | A1 | 9/2011 | Miyata et al. | |
| 2011/0234700 | A1 | 9/2011 | Kobayashi | |
| 2012/0236080 | A1 | 9/2012 | Yoshida | |
| 2013/0021408 | A1 | 1/2013 | Morgan et al. | |

FOREIGN PATENT DOCUMENTS

JP 10119261 A 5/1998

OTHER PUBLICATIONS

Lv et al~Design and Simulation of Electrostatic Inkjet Head~Conf on Nano/Micro Engineered & Molecular Systems~Jan. 20-23, 2010~pp. 532-536.

* cited by examiner

*Primary Examiner* — Alejandro Valencia
(74) *Attorney, Agent, or Firm* — HP Inc. Patent Department

(57) ABSTRACT

An example provides a plurality of nozzles; a common fluid supply channel in fluid communication with the plurality of nozzles and a compressible material forming, at least in part, a compressible wall of the common fluid supply channel, wherein the compressible wall has a volume and wherein the volume changes in response to changes in pressure in the common fluid supply channel.

20 Claims, 12 Drawing Sheets

FLUID EJECTION APPARATUSES INCLUDING COMPRESSIBLE MATERIAL

CROSS REFERENCE TO RELATED APPLICATION

The present application is a divisional application claiming priority under 35 USC § 120 from co-pending U.S. patent application Ser. No. 13/931,381 filed on Jun. 28, 2013 by McKinnel et al. AND ENTITLED FLUID EJECTION APPARATUSES including COMPRESSIBLE MATERIAL, the full disclosure of which is hereby incorporated by reference.

BACKGROUND

Drop-on-demand inkjet printers are commonly categorized according to one of two mechanisms of drop formation within an inkjet printhead. Thermal inkjet printers may use inkjet printheads with heating element actuators that vaporize ink, or other print fluid, inside ink-filled chambers to create bubbles that force ink droplets out of the printhead nozzles. Piezoelectric inkjet printers may use inkjet printheads with piezoelectric ceramic actuators that generate pressure pulses inside ink-filled chambers to force droplets of the ink out of the printhead nozzles.

BRIEF DESCRIPTION OF THE DRAWINGS

The Detailed Description section references the drawings, wherein.

and all in which various embodiments may be implemented.

DETAILED DESCRIPTION

Inkjet printheads may include a common fluid supply channel that provides a source of ink for a plurality of firing chambers for ejecting a fluid, such as ink, from the printhead through corresponding nozzles. When a nozzle is fired, the advance portion of the pressure wave may direct ink toward the nozzle for ejection, while the retrograde portion of the pressure wave may direct ink back toward the common fluid supply channel. Sometimes, a considerable dynamic pressure may develop in the common fluid supply channel, especially in cases in which the dimension of the common fluid supply channel is relatively small. This dynamic pressure may result, for example, in diminished printhead stability and fluidic cross-talk across the firing chambers/nozzles fluidly coupled to the common ink supply channel.

In some cases, a common fluid supply channel may include a thin flexible membrane to counter transient pressure changes. The membrane may be disposed between the common fluid supply channel and a cavity, and may flex into the cavity upon increased pressure within the common fluid supply channel or flex into the common fluid supply channel (and away from the cavity) upon decreased pressure within the common fluid supply channel. In addition to the complexity of incorporating the membrane and cavity into the printhead structure, and possibility of damaging the membrane during fabrication, the membrane/cavity structure typically requires venting to accommodate the flexing of the membrane and this may add further complexity to the fabrication. In addition, the membranes may stretch or tear, which may impact the performance of the printhead. In some cases, a pin hole may develop in the membrane, allowing fluid to seep into the cavity and resulting in decreased performance of the printhead or failure altogether.

Described herein are embodiments of fluid ejection apparatuses including a compressible material forming, at least in part, a wall of a common fluid supply channel. Various implementations may provide a robust structure that incurs little or no stretching or tearing on transient high-pressure events, may incur little or no performance impact should the compressible material develop a pin hole, or may avoid complicated fabrication techniques such as venting.

Figure 1:
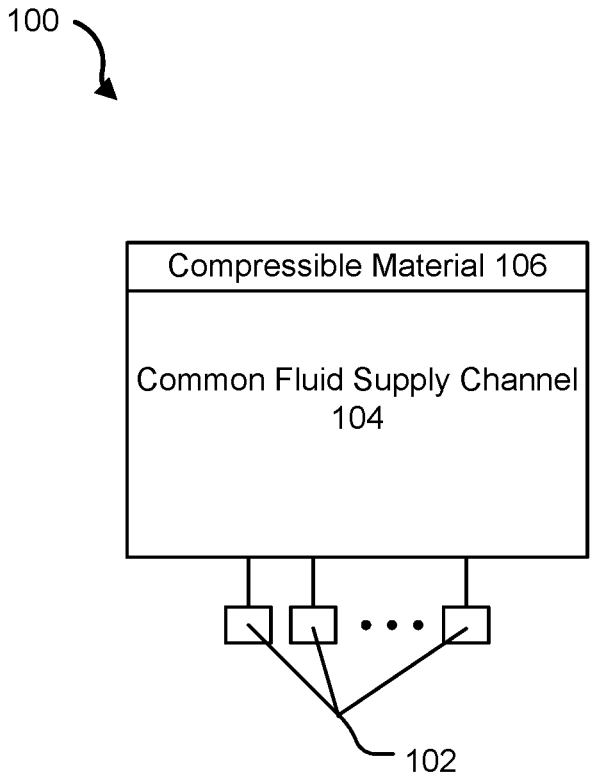
FIG. 1 is a block diagram of an example fluid ejection apparatus.

An example fluid ejection apparatus 100 is illustrated in FIG. 1. As illustrated, the fluid ejection apparatus 100 may include a plurality of nozzles 102, a common fluid supply channel 104 in fluid communication with the plurality of nozzles 102, and a compressible material 106 forming, at least in part, a wall of the common fluid supply channel 104. In various implementations, the apparatus 100 may comprise, at least in part, a printhead or printhead assembly. In some implementations, for example, the fluid ejection apparatus 100 may be an inkjet printhead or inkjet printing assembly.

The compressible material 106 may be configured to alleviate pressure surges from pulsing fluid flows through the fluid ejection apparatus 100 due to start-up transients, nozzle firing or priming, and fluid ejections in adjacent nozzles, for example. In various implementations, the compressible material 106 may comprise a material having a property of compressing in response to an increase in pressure in the common fluid supply channel 104. Transient increases in pressure in the common fluid supply channel 104 may occur, for example, when the nozzles are fired or primed. The compressible material 106 may also have a property of expanding in respond to a decrease in pressure in the common fluid supply channel 104. Transient decreases in pressure in the common fluid supply channel 104 may occur, for example, during operation as the firing chamber (not illustrated here), coupled between one of the nozzles 102 and the common fluid supply channel 104, draws ink or other printing fluid from the common fluid supply channel 104. In various implementations, the compressibility and/or expandability of the compressible material 106 may have a dampening effect on fluidic cross-talk between adjacent nozzles as well as act as a reservoir to ensure fluid is available while flow is established from the fluid supply during high-volume printing, for example.

Figure 2:
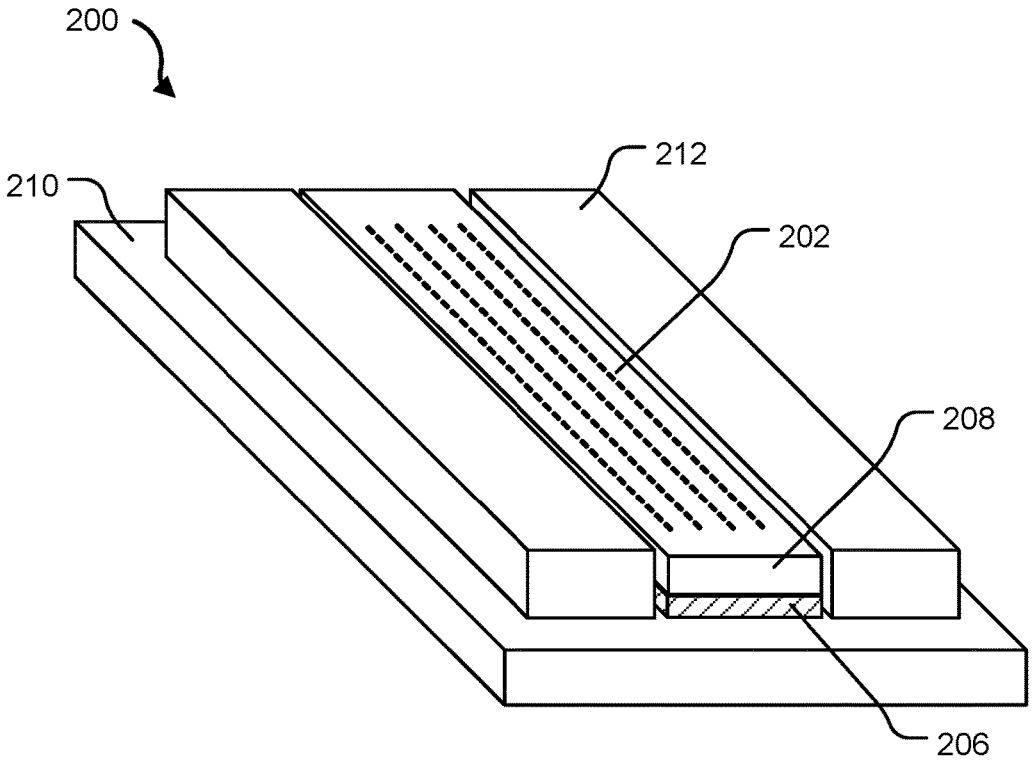
FIG. 2 illustrates another example fluid ejection apparatus.

FIG. 2 illustrates another example fluid ejection apparatus 200. The apparatus 200 may be configured to eject drops of a fluid (such as, e.g., ink, etc.) through a plurality of nozzles 202. The plurality of nozzles 202 may be arranged in one or more columns or arrays such that properly sequenced ejection of ink from the plurality of nozzles 202 may form characters or images onto a medium (not illustrated) as the apparatus 200 and the medium are moved relative to each other.

The apparatus 200 may include an ejector structure 208, which may include the plurality of nozzles 202. The ejector structure 208 may be coupled to a substrate die 210 such that a compressible material 206 is between the ejector structure 206 and the substrate die 210, as illustrated. The compressible material 206 may form, at least in part, a wall of a common fluid supply channel (not illustrated here), which may or may not be part of the ejector structure 208. Although not illustrated here, in various implementations, the apparatus 200 may also include firing chambers fluidly coupling corresponding ones of the nozzles 202 to the common fluid supply channel, and actuators configured to deflect into a corresponding one of the firing chambers to cause fluid to be ejected through a corresponding one of the nozzles 202.

In various implementations, the substrate die 210 may comprise silicon or another substrate. In various implementations, the compressible material 206 may comprise a polymer, an elastomer, a foam, or a combination thereof. The compressible material 208 may substantially solid, with few, if any voids, other than those that may be present in the closed-cells of the material. Examples of suitable materials for the compressible material 206 may include, but are not limited to, silicone rubber, closed-cell solid foams, silicone foams, and fluoro-silicone foams. Other materials may be similarly suitable in some implementations.

The compressible material 206 may have a compliance value to allow for compressing in response to an increase in pressure in the common fluid supply channel or compressing in response to an increase in pressure in the common fluid supply channel and expanding in response to a decrease in pressure in the common fluid supply channel. In various implementations, the compressible material 206 may comprise a material having a compliance value of up to about $7\times10^{-15}$ $m^3$/Pa (this may correspond, e.g., to a compression of about 25% with a load in a range between about 2 psi and about 7 psi for a 0.5 mm×22 mm×0.7 mm layer of material). In some of these implementations, the compressible material may comprise a soft silicone rubber closed-cell foam layer. In some implementations, the compressible material 206 may comprise a material having a compliance value of at least about $2\times10^{-15}$ $m^3$/Pa. In some implementations, the compressible material 206 may comprise a material having a compliance value of at least about $2.5\times10^{-15}$ $m^3$/Pa.

In various implementations, the compressible material 206 may have a thickness in a range of about 0.1 microns to about 10 microns. In some examples, the compressible material 106 has a thickness in a range of about 3 microns to about 10 microns. Other thicknesses may be suitable for a number of other implementations within the scope of the present disclosure.

The ejector structure 208 may include circuitry 212 for driving one or more of the actuators of the ejector structure 208. In various implementations, the ejector structure 208 may comprise a multilayer micro-electro-mechanical system (MEMS) die stack. In various implementations, the ejector structure 208 may be formed of at least in part, of silicon or another material.

Figure 3:
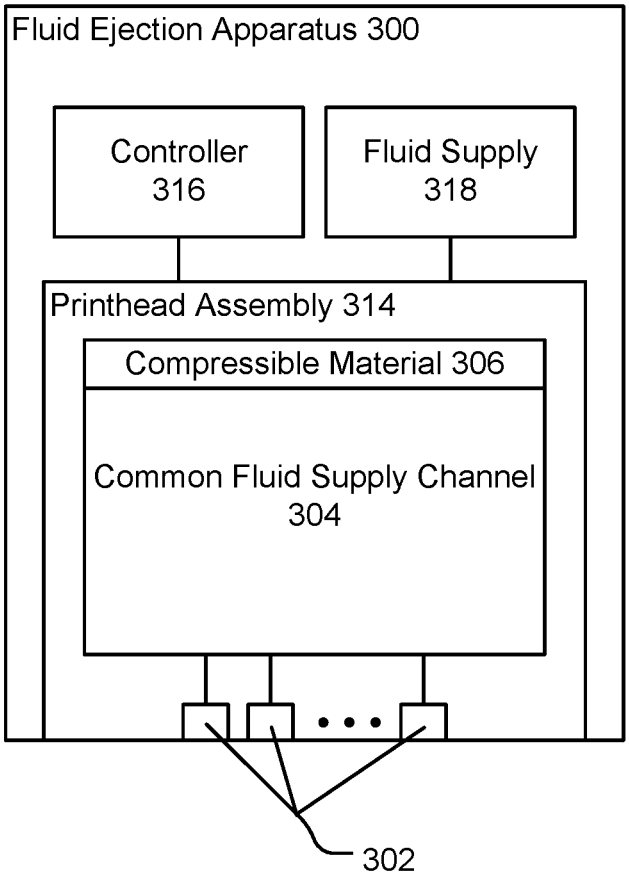
FIG. 3 illustrates another example fluid ejection apparatus.

FIG. 3 illustrates another example fluid ejection apparatus 300. As illustrated, the apparatus 300 may include a printhead assembly 314, a controller 316, and a fluid supply 318. The printhead assembly 314 may include a plurality of nozzles 302, a common fluid supply channel 304 in fluid communication with the plurality of nozzles 302, and a compressible material 306 forming, at least in part, a wall of the common fluid supply channel 304.

The controller 316 may be configured to control ejection of fluid by the printhead assembly 314. In various implementations, the controller 316 may comprise one or more processors, firmware, software, one or more memory components including volatile and non-volatile memory components, or other printer electronics for communicating with and controlling the printhead assembly 314. The controller 316 may be configured to communicate with and control one or more other components such as, but not limited to, a mounting assembly (not illustrated) to position the printhead assembly 314 relative to a media transport assembly (not illustrated), which may position a print media relative to the print head assembly 314.

In some implementations, the controller 316 may control the printhead assembly 314 for ejection of ink drops from one or more of the nozzles 302. The controller 316 may define a pattern of ejected ink drops that form characters or images onto a medium. The pattern of ejected ink drops may be determined by a print job command and/or command parameter from data, which may be provided by a host system to the controller 316.

The fluid supply 318 may supply fluid to the printhead assembly 314. In some implementations, the fluid supply 318 may be included in the printhead assembly 314, rather than separate as illustrated. In various implementations, the fluid supply 318 and the printhead assembly 314 may form either a one-way ink delivery system or a recirculating ink delivery system. In a one-way ink delivery system, substantially all of the ink supplied to inkjet printhead assembly 314 may be consumed during printing. In a recirculating ink delivery system, however, only a portion of the ink supplied to the printhead assembly 314 may be consumed during printing and ink not consumed during printing may be returned to the fluid supply 318.

Figure 4A:
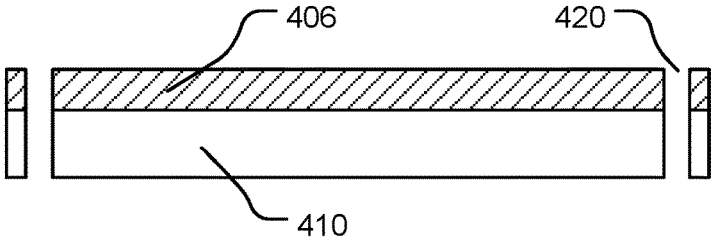
FIGS. 4A, 4B, and 4C illustrate various views of an example compressible material.
Figure 4B:
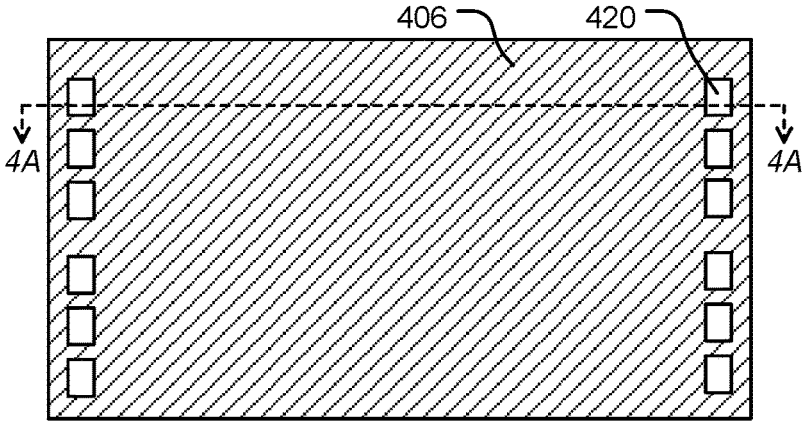
Figure 4C:
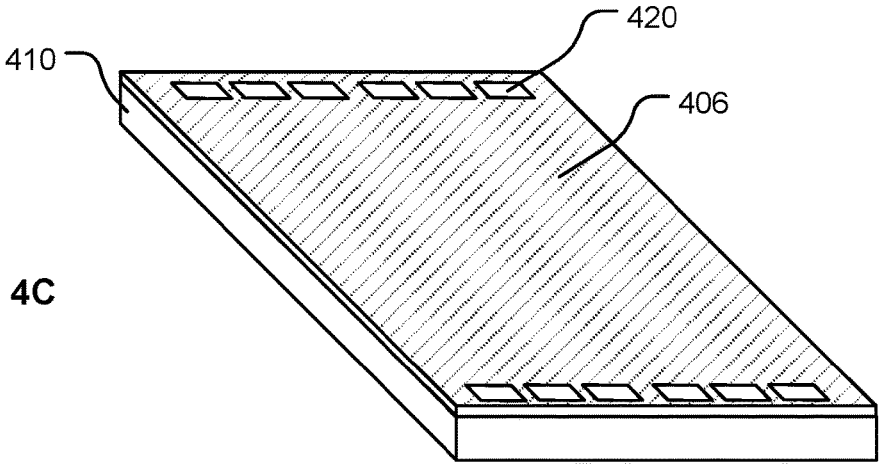

FIGS. 4A, 4B, and 4C are various views of an example compressible material 406 that may be suitable for fabricating a fluid ejection apparatus. In various implementations, the compressible material 406 may comprise a sheet of compressible material, which may be coupled to a substrate die 410. As shown, the substrate die 410 and the compressible material 406 may include fluid feed slots, channels, or holes 420. The fluid feed slots, channels, or holes 420 may comprise one or more passageways for passage of fluid to and from the common fluid supply channel. In various implementations, the substrate die 410 may comprise silicon, but in other implementations may comprise another suitable substrate material.

In some implementations, a sheet of the compressible material 406 may be coupled to the substrate die 410, cut to a dimension suitable for the configuration of the fluid ejection apparatus, and coupled to an ejector structure including the common fluid supply channel (illustrated and discussed elsewhere). In some implementations, the sheet of compressible material 406 may be cut to a suitable dimension before coupling to the substrate die 410. In other implementations, the compressible material 406 may be fabricated by curing a pre-cursor of the compressible material. In some of these implementations, the pre-cursor may be applied directly onto a pre-formed common fluid supply channel.

Figure 5:
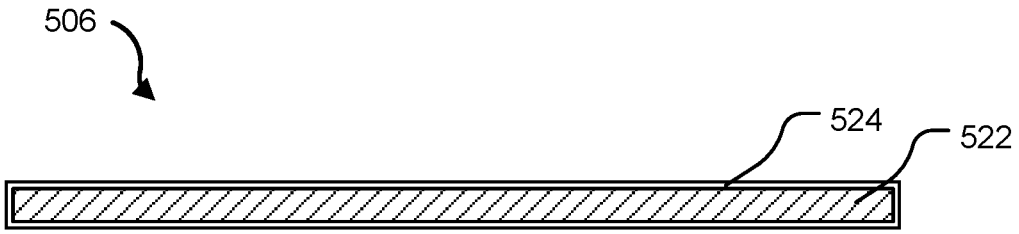
FIG. 5 illustrates another example compressible material.

FIG. 5 illustrates another example of compressible material 506. As illustrated, the compressible material 506 may comprise a first layer 522 and a second layer 524 on the first layer 522. In various implementations, the second layer 524 may comprise a material that is substantially fluid impermeable and may be arranged such that the second layer 524 is between the common fluid supply channel and the first layer 522. In some of these latter examples, the first layer 522 may or may not be a substantially fluid-impermeable material (such as, for example, a closed-cell foam, etc.).

In various implementations, the first layer 522 may have a thickness in a range of about 0.1 microns to about 10 microns, and the second layer 524 may have a thickness in a range of about 0.05 microns to about 0.5 microns. Other thicknesses for the first layer 522 and the second layer 524 may be suitable for a number of other implementations within the scope of the present disclosure.

In various implementations, the first layer 522 and/or the second layer 524 may comprise a polymer, an elastomer, a foam, or a combination thereof. Examples of suitable materials for the first layer 522 may include, but are not limited to, silicone rubber, closed-cell solid foams, silicone foams (such as, e.g., fluoro-silicone foams). In some implementations, the first layer 522 may comprise a polymer, an elastomer, a foam, or a combination thereof, and the second layer 524 may comprise a metal or inorganic material applied to the first layer 522. Other materials may be similarly suitable in some implementations. In some implementations, the second layer 524 may be applied to the first layer 522 using a suitable deposition operation such as, for example, atomic layer deposition, a chemical vapor deposition operation, or the like.

It is noted that although the compressible material 506 is illustrated as comprising the second layer 524 completely surrounding the first layer 522, other configurations may be possible. For example, in some implementations, the second layer 524 may be formed on a single or fewer than all sides of the first layer 522.

Figure 6:
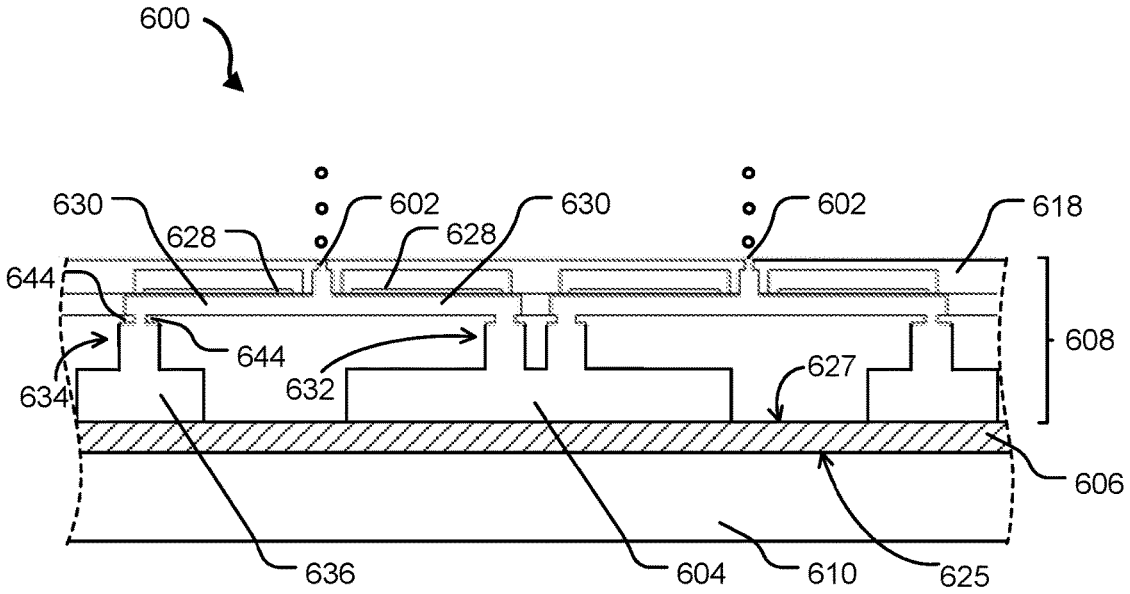
FIGS. 6-9 illustrate various examples of the fluid ejection apparatus.

FIG. 6 illustrates a sectional view of another example fluid ejection apparatus 600. As illustrated, the apparatus 600 includes a plurality of nozzles 602, a common fluid supply channel 604 in fluid communication with the plurality of nozzles 602, and a compressible material 606 forming, at least in part, a wall of the common fluid supply channel 604.

The plurality of nozzles 602 and the common fluid supply channel 604 may form, at least in part, an ejector structure 608. In various implementations, the apparatus 600 may include a substrate die 610 arranged such that the compressible material 606 is between the ejector structure 608 and the substrate die 610. As illustrated, a first surface 625 of the compressible material 606 abuts against the substrate die 610, and a second surface 627, opposite the first surface, faces the common fluid supply channel 604.

In some implementations, the ejector structure 608 may be formed, at least in part, of silicon. In some implementations, the nozzle layer 626 may be formed stainless steel or chemically-inert polymer such as, for example, polyimide or SU8 photoresist. The layers of the ejector structure 608 may be integral or may be bonded together with an adhesive (not illustrated). In various implementations, the ejector structure 608 may comprise a multilayer micro-electro-mechanical system (MEMS) die stack, which may include drive circuitry for driving one or more of a plurality of actuators 628 of the ejector structure 608.

As illustrated, each of the plurality of nozzles 602 is in fluid communication with at least one of a plurality of firing chambers 630. The plurality of actuators 628 may be configured to deflect into a corresponding one of the firing chambers 630 to cause fluid to be ejected through a corresponding one of the nozzles 602. In some implementations, the actuators 628 may comprise piezoelectric actuators. Other types of actuators such as, for example, heating elements or other actuators may be used for the actuators 628 in other implementations within the scope of the present disclosure.

The apparatus 600 may include a plurality of ports 632, 634 fluid coupling the common fluid supply channel 604 to the individual firing chambers 630. In some implementations, at least one of the ports 632, 634 may include restrictors 644 protruding into the openings defined by the ports 632, 634. As illustrated, the restrictors 644 comprise pairs of protrusions configured to control a flow rate of fluid between the common fluid supply channel 604 and the firing chambers 630. In various implementations, the restrictors 644 may have varying sizes (i.e., protrusion into the openings defined by the ports 632, 634) to control a flow rate. In other implementations, one or more of the individual restrictors 644 may be omitted altogether.

In some implementations, one of the ports 632 may configured to provide fluid to the firing chamber 630 from the common fluid supply channel 604, and the other one of the ports 634 may be configured to separately provide fluid to the firing chamber 630 from another channel 636. The other channel 636 may comprise another common fluid supply channel similarly configured to the common fluid supply channel 604, with the compressible material 606 forming, at least in part, a wall of the other channel 636. As illustrated, the same sheet or layer of compressible material 606 may form, at least in part, the walls of both the common fluid supply channel 604 and the other channel 636.

In other implementations, the other channel 636 may comprise an exit manifold such that fluid may be circulated through the firing chamber 630, with one of the ports 632 forming an inlet to the firing chamber 630 and the other one of the ports 634 forming an outlet from the firing chamber 630. In various implementations, the fluid may be circulated by external pumps of a fluid supply (not illustrated here).

Figure 7:
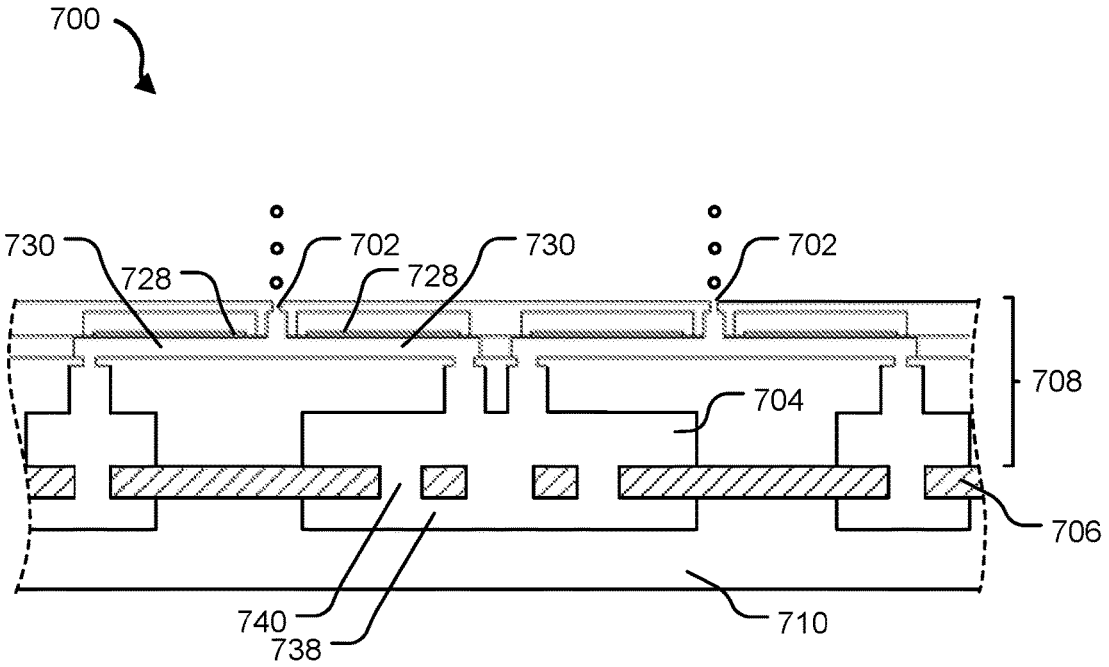

FIG. 7 is a sectional view of another example fluid ejection apparatus 700. As illustrated, the apparatus 700 includes a plurality of nozzles 702, a common fluid supply channel 704 in fluid communication with the plurality of nozzles 702, and a compressible material 706 forming, at least in part, a wall of the common fluid supply channel 704. The apparatus 700 may include an ejector structure 708 similar to that of the apparatus 600 described herein with reference to FIG. 6. As illustrated, the apparatus 700 may be arranged such that the compressible material 706 is between the ejector structure 708 and a substrate die 710. The plurality of nozzles 702 may be in fluid communication with at least one of a plurality of firing chambers 730. A plurality of actuators 728 may be configured to deflect into a corresponding one of the firing chambers 730 to cause fluid to be ejected through a corresponding one of the nozzles 702.

The substrate die 710 may include at least one recess 738 such that the compressible material 706 is between the recess 738 and the common fluid supply channel 704, as illustrated. In various ones of these implementations, the compressible material 706 may include at least one opening 740 fluidly coupling the common fluid supply channel 704 to the recess 738. In this configuration, the recess 738 may form, at least in part, a second common fluid supply channel. In various ones of these implementations, fluid may be provided to the common fluid supply channel 704 via the recess 738. In some of these embodiments, the fluid may be provided to the substrate die 710 (by a through-slot or through an end of the substrate die 710, for example).

Figure 8:
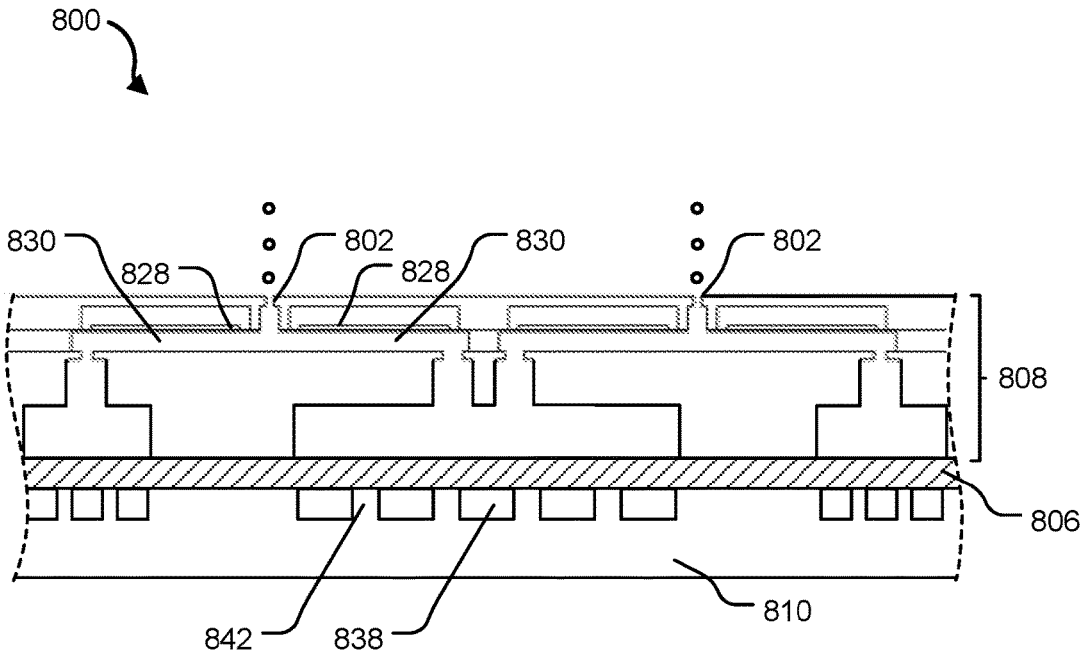

FIG. 8 is a sectional view of another example fluid ejection apparatus 800. Similarly to various implementations described herein, the apparatus 800 includes a plurality of nozzles 802, a common fluid supply channel 804 in fluid communication with the plurality of nozzles 802, and a compressible material 806 forming, at least in part, a wall of the common fluid supply channel 804. The plurality of nozzles 802 and the common fluid supply channel 804 may form, at least in part, an ejector structure 808, and the apparatus 800 may be arranged such that the compressible material 806 is between the ejector structure 808 and a substrate die 810. The plurality of nozzles 802 may be in fluid communication with at least one of a plurality of firing chambers 830. A plurality of actuators 828 may be configured to deflect into a corresponding one of the firing chambers 830 to cause fluid to be ejected through a corresponding one of the nozzles 802.

As illustrated, the recess 838 in the substrate die 810 may include a plurality of posts 842. The post 842 may support the compressible material 806 to limit deformation of the compressible material 806 into the recess 838 to allow the compressible material 806 to compress. In various implementations, the compressible material 806 may be coupled to the posts 842 with an adhesive, for example. In some implementations, the compressible material 806 may not be coupled to the posts 842.

In various implementations, the apparatus 800 may include the compressible material 706 described herein with reference to FIG. 7 with openings to fluidly couple the recess 838 with the common fluid supply channel 804. In various ones of these implementations, fluid may be provided to the common fluid supply channel 804 via the recess 838.

Figure 9:
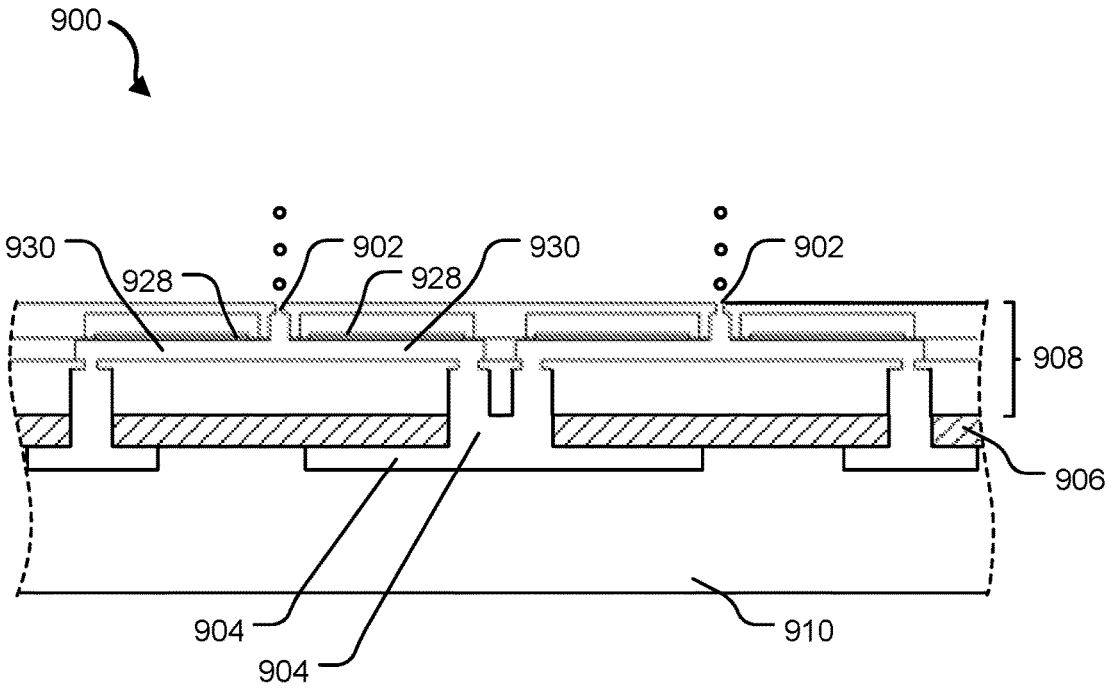

FIG. 9 is a sectional view of another example fluid ejection apparatus. Similarly to various implementations described herein, the apparatus 900 includes a plurality of nozzles 902, a common fluid supply channel 904 in fluid communication with the plurality of nozzles 902, and a compressible material 906 forming, at least in part, a wall of the common fluid supply channel 904. The plurality of nozzles 902 may be in fluid communication with at least one of a plurality of firing chambers 930, and a plurality of actuators 928 may be configured to deflect into a corresponding one of the firing chambers 930 to cause fluid to be ejected through a corresponding one of the nozzles 902. The nozzles 902, actuators 928, and the firing chambers 930 may form, at least in part, an ejector structure 908, and the apparatus 900 may be arranged such that the compressible material 906 is between the ejector structure 908 and a substrate die 910.

The substrate die 910 may include the common fluid supply channel 904, as illustrated, such that the compressible material 906 is between the ejector structure 908 and at least a portion of the common fluid supply channel 904, as illustrated. The compressible material 906 may include at least one opening 940 fluidly coupling the common fluid supply channel 904 to the firing chamber 930. In various ones of these implementations, fluid may be provided to the common fluid supply channel 904 via the recess 938. In some of these embodiments, the fluid may be provided to the substrate die 910 (by a through-slot or through an end of the substrate die 910, for example).

Figure 10A:
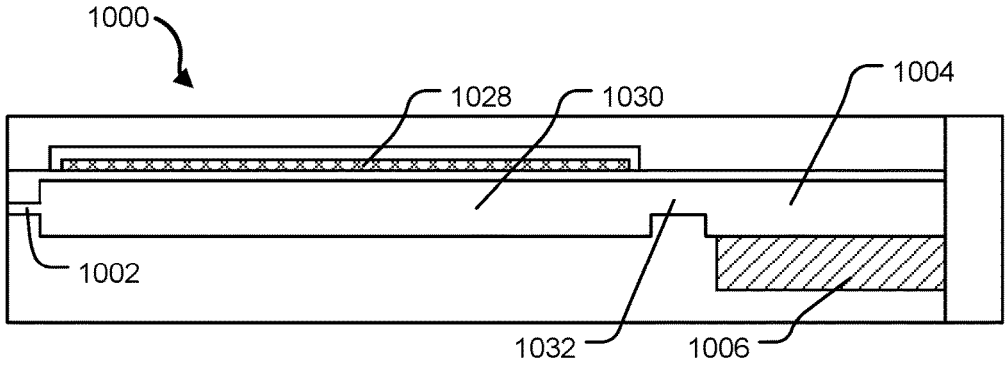
FIGS. 10A and 10B illustrate various views of another example fluid ejection apparatus.
Figure 10B:
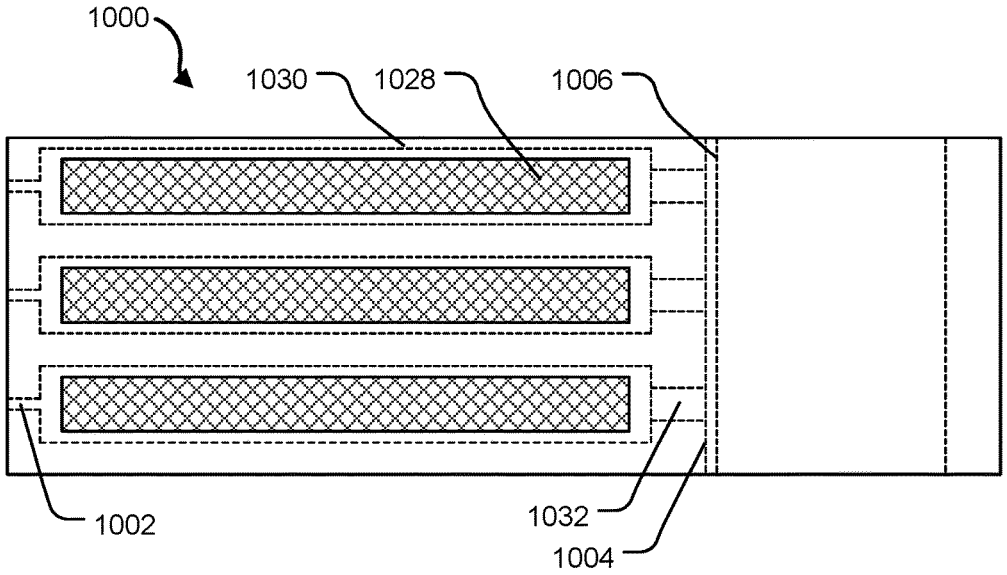

FIGS. 10A and 10B are views of another example of a fluid ejection apparatus 1000. Similarly to various implementations described herein, the apparatus 1000 includes a plurality of nozzles 1002, a common fluid supply channel 1004 in fluid communication with the plurality of nozzles 1002, and a compressible material 1006 forming, at least in part, a wall of the common fluid supply channel 1004. As illustrated, the compressible material 1006 may extend along the common fluid supply channel 1002. The common fluid supply channel 1002 may be fluidly coupled to the individual firing chambers 1024, and the plurality of nozzles 1002 may be in fluid communication with at least one of a plurality of firing chambers 1030. One of the actuators 1028 may be configured to deflect into a corresponding one of the firing chambers 1030 to cause fluid to be ejected through a corresponding one of the nozzles 1002.

Figure 11:
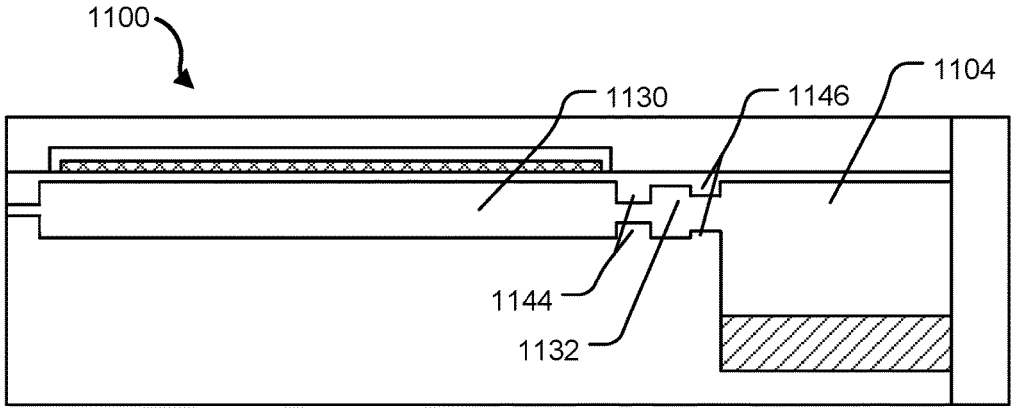
FIG. 11 illustrates another example fluid ejection apparatus.

The common fluid supply channel 1004 may be fluidly coupled to the individual firing chambers 1030 by ports 1032. As illustrated, the ports 1032 have a passageway opening that is smaller than those of the firing chambers 1030 (as illustrated, width, depth, and length are smaller). In various implementations, the dimensions of the ports 1032 may be configured to control a flow rate of fluid between the common fluid supply channel 1004 and the firing chambers 1024. In other implementations, the ports 1032 may include one or more dimensions substantially the same as the firing chambers 1030 and/or the common fluid supply channel 1004. FIG. 11 illustrates an example implementation of a fluid ejection apparatus 1100 in which the ports 1132 of a fluid ejection apparatus 1100 include restrictors 1144, 1146 protruding into the openings defined by the ports 1132. As illustrated, the restrictors 1144, 1146 comprise pairs of protrusions configured to control a flow rate of fluid between the common fluid supply channel 1104 and the firing chambers 1130. In various implementations, the restrictors 1144, 1146 may have varying sizes (i.e., protrusion into the openings defined by the ports 1132) to control a flow rate. In other implementations, one or more of the individual restrictors 1144, 1146 may be omitted altogether.

Figure 12A:
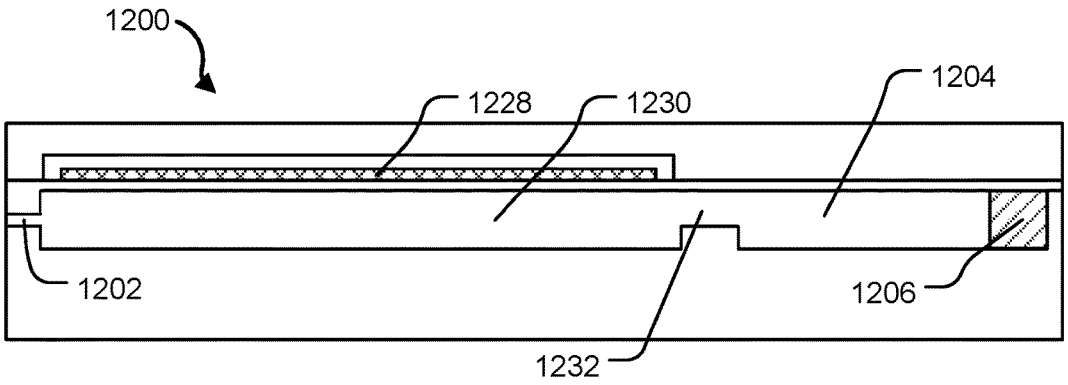
FIGS. 12A and 12B illustrate various views of another example fluid ejection apparatus.
Figure 12B:
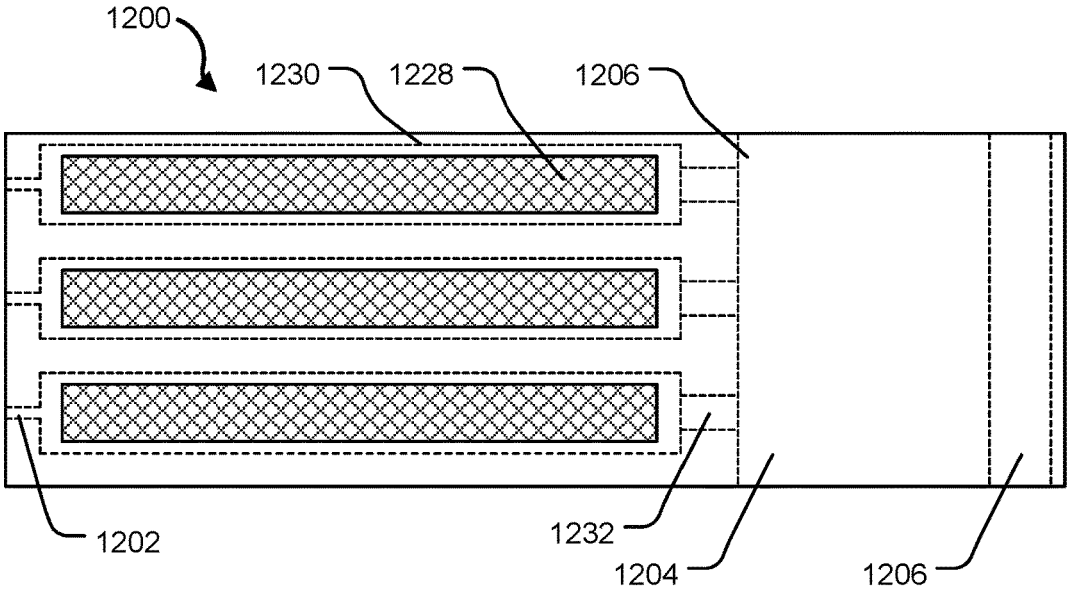

FIGS. 12A and 12B are views of another example fluid ejection apparatus 1200. Similarly to various implementations described herein, the apparatus 1200 includes a plurality of nozzles 1202, a common fluid supply channel 1204 in fluid communication with the plurality of nozzles 1202, and a compressible material 1206 forming, at least in part, a wall of the common fluid supply channel 1204. The common fluid supply channel 1202 may be fluidly coupled to the individual firing chambers 1230, and the plurality of nozzles 1202 may be in fluid communication with at least one of a plurality of firing chambers 1230. One of the actuators 1228 may be configured to deflect into a corresponding one of the firing chambers 1230 to cause fluid to be ejected through a corresponding one of the nozzles 1202.

As illustrated, the compressible material 1206 may extend along the common fluid supply channel 1202. Rather than on the bottom wall of the common fluid supply channel 1204 as in the implementation described herein with reference to FIG. 10A/10B, the compressible material 1206 may instead be disposed on a side wall of the common fluid supply channel 1202 opposite the ports 1232, as illustrated. In various non-illustrated implementations, the compressible material 1206 may extend along multiple walls of the common fluid supply channel 1204 (such as, e.g., the bottom wall and a side wall).

Various aspects of the illustrative embodiments are described herein using terms commonly employed by those skilled in the art to convey the substance of their work to others skilled in the art. It will be apparent to those skilled in the art that alternate embodiments may be practiced with only some of the described aspects. For purposes of explanation, specific numbers, materials, and configurations are set forth in order to provide a thorough understanding of the illustrative embodiments. It will be apparent to one skilled in the art that alternate embodiments may be practiced without the specific details. In other instances, well-known features are omitted or simplified in order not to obscure the illustrative embodiments.

The phrases "in an example," "in various examples," "in some examples," "in various embodiments," and "in some embodiments" are used repeatedly. The phrases generally do not refer to the same embodiments; however, they may. The terms "comprising," "having," and "including" are synonymous, unless the context dictates otherwise. The phrase "A and/or B" means (A), (B), or (A and B). The phrase "A/B" means (A), (B), or (A and B), similar to the phrase "A and/or B". The phrase "at least one of A, B, and C" means (A), (B), (C), (A and B), (A and C), (B and C), or (A, B and C). The phrase "(A) B" means (B) or (A and B), that is, A is optional. Usage of terms like "top", "bottom", and "side" are to assist in understanding, and they are not to be construed to be limiting on the disclosure.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of this disclosure. Those with skill in the art will readily appreciate that embodiments may be implemented in a wide variety of ways. This application is intended to cover any adaptations or variations of the embodiments discussed herein. It is manifestly intended, therefore, that embodiments be limited only by the claims and the equivalents thereof.

What is claimed is:

1. A fluid ejection apparatus comprising:

a plurality of nozzles;

a first common fluid supply channel in fluid communication with a first portion of the plurality of nozzles;

a second common fluid supply channel, distinct from the first common fluid supply channel, in fluid communication with a second portion of the plurality of nozzles; and a compressible material forming, at least in part, a compressible wall of the common fluid supply channel, wherein the compressible wall has a volume, wherein the volume changes in response to changes in pressure in the common fluid supply channel and wherein the compressible wall comprises a single compressible wall continuously extending across the first common fluid supply channel and the second common fluid supply channel.

2. The apparatus of claim 1, wherein the compressible wall has a compliance value of at least $2\times10^{-15}$ $m^3$/Pa.

3. The apparatus of claim 2, where the compressible wall has a compliance value no greater than $7\times10^{-15}$ $m^3$/Pa.

4. The apparatus of claim 3, wherein the compressible material is selected from polymers, elastomers, foams, and combinations thereof.

5. The apparatus of claim 4, wherein the compressible material comprises a first layer and a second layer on the first layer, wherein the second layer is substantially fluid impermeable and separates the first layer from the first common fluid supply channel, wherein the first layer has a thickness in a range of about 0.1 microns to about 10 microns, and wherein the second layer has a thickness in a range of about 0.05 microns to about 0.5 microns.

6. The apparatus of claim 4 further comprising a firing chamber, wherein the first common fluid supply channel comprises an outlet connected to the firing chamber and extending in a direction parallel to a direction in which the nozzles open to eject fluid, wherein the compressible wall extends adjacent the first common fluid supply channel and opposite to the outlet, wherein a portion of the compressible wall opposite to the outlet has a first face adjacent the common fluid supply channel and a second face, opposite the first face, wherein the apparatus further comprises a support surface in abutting contact with the second face of the portion of the compressible wall and opposite to the outlet and wherein the support surface is in abutting contact with an entirety of the second face.

7. The apparatus of claim 4 further comprising a firing chamber, wherein the first common fluid supply channel comprises an outlet connected to the firing chamber and extending in a direction parallel to a direction in which the nozzles open to eject fluid, wherein the compressible wall extends adjacent the first common fluid supply channel and opposite to the outlet, wherein a portion of the compressible wall opposite to the outlet has a first face adjacent the common fluid supply channel and a second face, opposite the first face, wherein the apparatus further comprises a support surface in abutting contact with the second face of the portion of the compressible wall and opposite to the outlet, the apparatus further comprising a recess adjacent the second face, wherein the support surface is within the recess and is spaced from opposite sides of the recess to inhibit deformation of the compressible wall into the recess and promote compression of the compressible wall.

8. The apparatus of claim 7 further comprising a substrate die, the substrate die forming the support surface.

9. The apparatus of claim 8, wherein the recess extends partially into the substrate die.

10. The apparatus of claim 4, wherein the first common fluid supply channel comprises a first side wall and a second side wall opposite and spaced from the first side wall to form a fluid chamber therebetween, wherein the compressible wall has a front face, including the first face and extending from the first side wall to the second sidewall adjacent the fluid chamber and a rear face, including the second face, and wherein the support surface is in abutting contact with an entirety of the rear face.

11. The apparatus of claim 4, further comprising:

a plurality of firing chambers, wherein each of the plurality of firing chambers fluidly couples the first common fluid supply channel to a corresponding one of the plurality of nozzles; and a plurality of piezoelectric actuators, each of the piezoelectric actuators to deflect into a corresponding firing chamber to cause fluid to be ejected through a corresponding nozzle.

12. The apparatus of claim 4 further comprising a recess adjacent the compressible wall, wherein the support surface is within the recess and is spaced from opposite sides of the recess to inhibit deformation of the compressible wall into the recess and promote compression of the compressible wall.

13. The apparatus of claim 12 further comprising a substrate die, the substrate die forming the support surface.

14. The apparatus of claim 13, wherein the recess extends partially into the substrate die.

15. The apparatus of claim 4 further comprising:

a recess adjacent the compressible wall on a side of the compressible wall opposite to the first common fluid supply channel; and a plurality of posts within the recess and spaced from sides of the recess to limit deformation of the compressible material.

16. The apparatus of claim 15, wherein the recess forms, at least in part, a third common fluid supply channel, and wherein the compressible material includes at least one opening fluidly coupling the first common fluid supply channel to the third common fluid supply channel.

17. The apparatus of claim 4, wherein the compressible wall has a first face adjacent the first common fluid supply channel and a second face, opposite the first face and wherein an entirety the second face is in abutting contact with a support.

18. The apparatus of claim 1, wherein the first portion of the plurality of nozzles forms a first row of nozzles extending along a first axis and wherein the second portion of the plurality of nozzles forms a second row of nozzles extending along a second axis different than the first axis.

19. The apparatus of claim 1 further comprising a plurality of firing chambers and a plurality of actuators adjacent the plurality of firing chambers, wherein the plurality of firing chambers are sandwiched between the plurality of actuators and the compressible wall.

20. The apparatus of claim 1 further comprising a plurality of firing chambers and a plurality of actuators adjacent the plurality of firing chambers, wherein the plurality of actuators, when actuated, deflect in a direction into the plurality of firing chambers towards the compressible wall.

* * * * *